United States Patent [19]

McManus

[11] 4,133,420

[45] Jan. 9, 1979

[54] COIN OPERATED COIN DEVICE FOR A COPY MACHINE

[75] Inventor: John W. McManus, Smithtown, N.Y.

[73] Assignee: Copylite, Inc., Fort Lauderdale, Fla.

[21] Appl. No.: 815,817

[22] Filed: Jul. 15, 1977

[51] Int. Cl.[2] ..... G07F 17/00

[52] U.S. Cl. ..... 194/9 T; 194/DIG. 18; 355/18

[58] Field of Search ..... 194/1 R, 9 R, 9 T, 10, 194/13, 15; 355/DIG. 18, 14, 18, 27, 30

[56] References Cited

U.S. PATENT DOCUMENTS

| | | | |
|---|---|---|---|
| 2,132,253 | 10/1938 | Wirt | 194/9 T |
| 3,065,667 | 11/1962 | Edgerton | 355/27 |
| 3,592,538 | 7/1971 | Ukai | 355/30 X |
| 3,737,017 | 6/1973 | Brunone | 194/13 |
| 3,737,734 | 6/1973 | Nakamura et al. | 355/14 x |
| 3,826,569 | 7/1974 | Sakamaki et al. | 355/14 |

*Primary Examiner*—Joseph J. Rolla
*Attorney, Agent, or Firm*—Malin & Haley

[57] ABSTRACT

A coin actuated print control device for operating a conventional electrostatic or bond copy machine, the device having a coin-operated mode and a direct print bypass mode. The device is easily and quickly coupled to a conventional electrostatic or bond copy machine, eliminating complex, electrical modifications of the conventional copy machine circuitry for providing for reliable coin actuated or bypass operation. The control device circuitry includes a power control relay which provides power to a receptacle plug in the device which is connected to the copy machine, a variable time delay circuit to allow warm-up time between coin actuation and print actuation, and a variable print process timing circuit to allow for power process print time (necessary for different copy machines) prior to shut down of the device.

4 Claims, 2 Drawing Figures

COIN OPERATED COIN DEVICE FOR A COPY MACHINE

BACKGROUND OF THE INVENTION

This invention relates generally to a control device which readily converts a conventional copy machine having a manually depressed print switch or the like to a coin actuated machine, the device allowing the machine to copy individual pages by the insertion of one or more proper combination of coins.

In the past, coin operated machines have been shown which are mechanically and electrically quite complex in construction and operation which have been constructed with the machine as a unitary system. Integral unitary constructed coin-operated copy machines have been constructed which employ such complex mechanical and electrical units.

Several electrostatic and bond copy machines which are actuated by a manually depressed print button are in widespread usage today. With the deployment of the control device of the instant invention, any conventional copy machine can be converted into a coin operated machine to provide single page copying requiring one or more coins for operation, with the instant invention being readily coupled to the conventional machine merely by connecting the power plug of the copy machine into a receptacle found in the control device and wiring the control device across the manual print switch actuating circuit of the copy machine. The instant invention further provides for a pair of variable circuit timer controls which allows the invention to be adapted to copy machines of different manufacturers for accommodating different warm-up process times for different machines.

Further the instant invention also includes the use of a by-pass mode control switch which can quickly and easily by-pass the coin operated function, allowing the device to be manually actuated without need for a coin.

BRIEF DESCRIPTION OF THE INVENTION

A control device for converting a conventional electrostatic or bond copy machine from a manual print operation to a coin operated operation, the control device comprising an inlet power source, a plug receptacle for coupling said control device to the inlet power line of a conventional copy machine, a coin actuated switching means connected to the inlet power source, a power control relay coupled to said coin actuated switching means, a print signal actuating circuit with a timer to control the length of time that the relay is actuated connected to said copy machine print actuating control switch, first time delay circuit means connected between said power control relay and said copy machine print actuating control switch, said first time delay means being variable and providing power from the inlet power source to the print control circuit which is delayed to allow for machine warm-up time. The control device further includes a shut down relay means connected to said print actuated circuit means, and a second timing circuit means connected between the print actuating control switch circuit means and the shut down relay, said second timing means being variable to allow proper process timing once the print cycle has begun in the copy machine to insure a complete printing process prior to the shut down of the control device. Once the control device is shut down in the coin operation mode, the print operation must be initiated by using another coin.

In the coin operated mode of operation, one or more coins is inserted into the coin actuating switch which provides power from the inlet power source (120 Volt AC line power) through the coin actuated switch, closing the power control relay which provides power to the copy machine receptacle coupled to the control circuit. When the power control relay picks up, power is also applied to a print actuating relay through a first time delay circuit which allows for variable adjustment to allow machine warm-up between the time power is received in the copy machine plug until the actual print signal is received in the machine. Thus the first time delay circuit includes a manually variable element such as a rheostat or the like which can be adjusted such that the print cycle is not actuated immediately upon coin insertion but at some period thereafter. Once the first timing delay circuit has been actuated, the print actuation control relay is picked up for a time which is fixed and controlled by a time delay circuit providing a control signal across the print switch of the copy machine causing the machine to begin its normal conventional cycle of operation. Also when the print control relay is actuated, a second timing circuit is initiated which is coupled to the shut down relay, the second timing circuit being variable to adjust the proper process time required for copying a single sheet in the particular machine. Once the timing sequence has run in the second timing circuit, the shut down relay is actuated which shuts off power to the copy machine and returns the power control relay to its initial rest position, the device being ready for another cycle and the copy machine not being able to be re-actuated unless additional proper coins are inserted.

In the by-pass mode of operation, the by-pass switch position in conjunction with the by-pass print button is coupled between the inlet power means and once depressed again picks up the power control relay initiating the operation of the device once the power control relay is picked up just as in the coin operated mode.

Thus with the present device, a retail store or the like can convert its present conventional copy machine into a coin operated device while still retaining the capability of direct manual print button operation if desired, the conversion requiring relatively simple electrical coupling into the print circuit.

It is an object of this invention to provide a coin actuated control device which readily converts a conventional manually actuated electrostatic or bond copy machine into a coin-operated print actuating device.

It is another object of this invention to provide a control device which allows for coin operated or manual actuation for a conventional copy machine which is readily connected to a conventional, initially manually operated, copy machine.

But yet still another object of this invention is to provide a control device for an electrostatic or bond copy machine which allows for coin actuated operation, the device including a pair of variable time delay circuits which may be utilized to accommodate different warm up and process times for different copy machines.

In accordance with these and other objects which will be apparent hereinafter, the instant invention will now be described with particular reference to the accompanying drawings.

PREFERRED EMBODIMENT OF THE INVENTION

Figure 1:
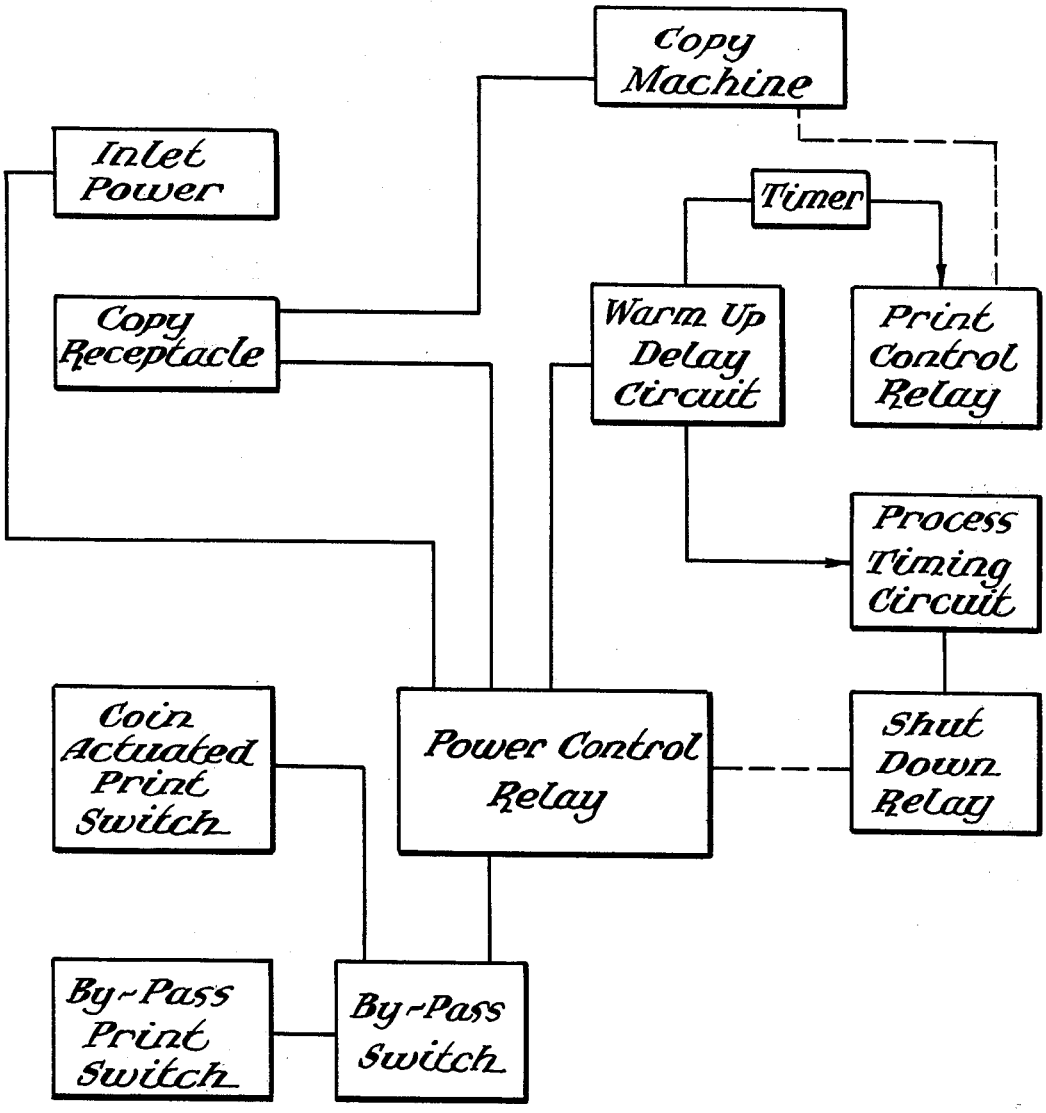
FIG. 1 shows the schematic block diagram of one embodiment of the instant invention.

FIG. 1 shows an operational schematic diagram of one embodiment of the invention in which the inlet 120 Volt AC power source (such as a plug to the device) is coupled to an inlet power plug receptacle mounted in the invention which receives the inlet power plug from the copy machine. The power control relay which provides power to the copy receptacle is picked up by either a coin actuated print switch caused by placing the proper coin within the coin receiving device or by the by-pass print switch in the by-pass position. The power control relay, once picked up, also provides power to a warm-up delay circuit connected to the print control relay which is coupled across the conventional manual print switch in the copy machine. After a particular amount of time, which is predetermined by the setting of the warm-up delay circuit, the print control relay is picked up, causing the copy machine to print one page. After the print control relay is picked up, power is also received in a process timing circuit which delays for a predetermined, adjustable amount of time the pick-up of the shut down relay. Once the process timing circuit (which is set in accordance with a particular copy machine) has timed out, the shut down relay is activated, turning off the power control relay, returning the system to its initial "off" condition.

Figure 2:
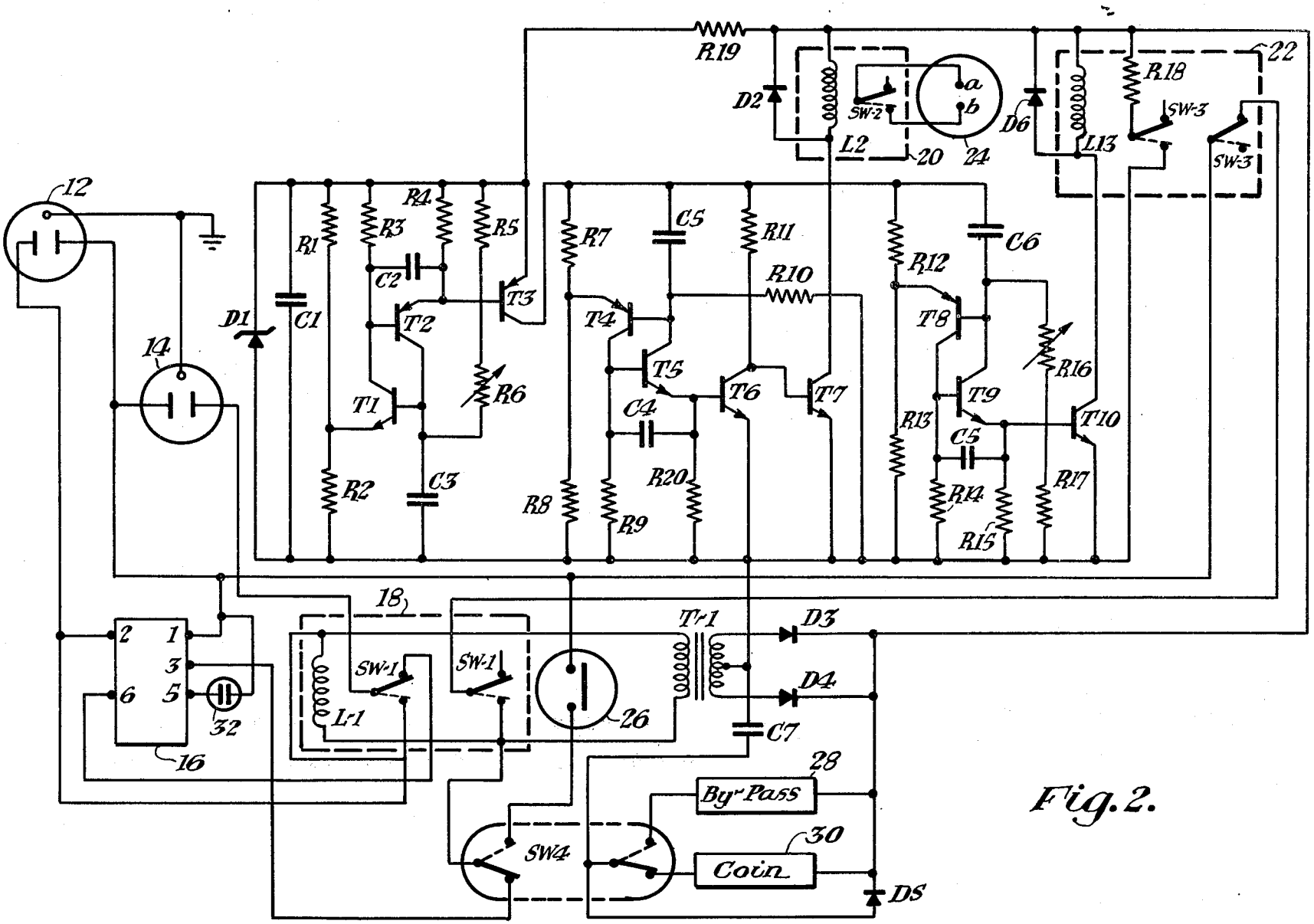
FIG. 2 shows a detailed schematic diagram of the circuitry utilized in the preferred embodiment of the instant invention.

Referring now to FIG. 2, one embodiment of the invention is shown with the circuit being in the coin operation mode. The device includes an inlet power plug 12 which couples into a conventional 120 Volt AC line which provides power to the unit. The plug 12 is coupled on one side to the coin actuated switch 16 having a plurality of terminals which will be described below. The other side of the plug 12 is coupled to one side of a power receptacle 14 which receives the inlet power plug of the copy machine. The receptacle plug 14 for the copy machine is coupled to a switch SW3 controlled by shut-down relay 22 on one side and to switch S1 located in the power control relay 18, the power control relay 18 being shown in the deenergized position. The power control relay 18 can be actuated in the coin operational mode by a proper coin being deposited in switch 16, or in the by-pass mode in which switch SW4 would then be positioned in the dotted position. Thus the purpose of the power control relay 18 is to provide power to the copy machine and to energize the copy machine control circuitry as a function of the timing delays which are described in greater detail below.

It is desirous to provide a variable timing delay between the coin actuation of switch 16 prior to the actual print button actuation (shown as contacts **24*a* and 24*b*) which provides the print signal to the machine, in view of the fact that many copy machines require a warm-up period (however short) from the application of power to the machine until the actual print cycle is ready to begin. The print timing delay is accomplished by a delay circuit comprising a plurality of transistors, T1, T2, T3, which cooperate in a network with a plurality of resistors R1, R2, R3, R4, R5, a variable resistor R6, capacitors C2, and C3. When the proper coin is dropped in coin switch 16, power is provided in coil L1 in relay 18 moving switches SW1 to the dotted position which also provides power to transformer T1. Once transformer T1 is energized, power is received into the print delay timing circuit, the length of delay being controlled by variable resistor R6 which can provide an adjustable delay of 3–30 seconds before coil L2 in relay 20 is energized. Once the print control relay 20 is energized, switch SW2 closes providing current to terminals 24*a* and 24*b* which are connected into a conventional print button or print actuating switch located in the copy machine. When power is received across terminals 24*a* and 24*b*, which are connected to the print actuating switch on a conventional copy machine, the print cycle begins and the copy machine functions conventionally. The timing circuit for relay 20 comprising a plurality of transistors T4, T5, T6, and T7 which co-operate in a network with a plurality of resistors R7, R8, R9, R10, R11, R11 and R20 in combination with a plurality of capacitors C4 and C5** also incorporates approximately a fixed one second delay to allow for the energizing of the print cycle.

Once the machine print cycle has begun, it is necessary to control the process time of the copy machine such that the machine will shut down after a single print is achieved, requiring the addition of another coin to make another print. The process timing is achieved by a circuit comprised of an array of transistors T8, T9, and T10 which function with resistors R12 and R13, R14, R15, variable resistors R16 and R17 in cooperation with capacitors C5 and C6 which determine the length of time until coil L3 is energized, energizing the shut down relay 22 through movement of switch SW3. When switch SW3 is moved to the dotted position shown, power through the copy machine power receptacle 14 is lost, shutting down relay 18, returning switch S1 to the position shown and deenergizing the entire system. Once the power is lost, relay 22 is likewise shut down and the system returns to its initial operational mode ready for the receipt of another coin. The process time from the time that the print signal is received by the copy machine until power is shut down by the machine is varied by resistor R16 which can be adjusted manually to a particular time print cycle peculiar to a particular commercial copy machine.

In the alternate mode of operation (by-pass mode) the device functions with switch SW4 being located in the dotted position shown. When switch SW4 is in the by-pass mode, the coin actuated switch 16 is, in effect, removed from the system such that depression of the by-pass print button 18 provides direct power to coil L1 again moving switch SW1 into the dotted position, energizing transistor T1, causing the system to function as in the coin operation mode.

The device also provides for the counting of the number of sheets printed by switch SW4 being either in the coin or by-pass counter mode such that a by-pass counter 28 and a coin counter 30 are provided which are actuated dependent upon the particular operational mode.

The following values are applicable and utilized in the embodiment shown in FIG. 2 as follows: Capacitors C1, 0.33 Microfarad; C2, 0.056 Microfarad; C3, 15 Microfarad; C4, 0.056 Mircofarad; C5, 1.0 Microfarad; C2, 15 Microfarad; C7, 47 Microfarads; C8, 0.056 Microfarad; Resistors R1, 6.8 KOhms; R2 6.8 KOhms; R3 560

Kohms; R4, 10 Kohms; R5, 220 Kohms; Variable resistor R6, 2.5 MOhms; R7, 10 KOhms; R8, 10 KOhms; R9, 560 KOhms; R10, 1.8 MOhms; R11, 3.9 KOhms; R12, 3.3 KOhms; R13, 3.3 KOhms; R14, 560 KOhms; R15, 10 KOhms; Variable resistor R16, 2.5 MOhms; R17, 220 KOhms; R19, 1.8 KOhms; and R20, 10 KOhms. Element D1 is a nine volt Zener diode; D3, D4, D5, and D6 are diodes One Amp/600 Volt. All NPN transistors are series 2N3568A or equivalent. All PNP transistors are a series 2N4248A or equivalent.

The coin actuated switch 16 is a series and model COINCO and includes an exact change lamp 32 which is illuminated whenever the device requires the use of exact change to operate the machine. The transformer is a Tempo model 2600041. The counters 28 and 30 are conventional Tamura model E507DC6 counters. Relay 18 is a Tempo Model No. 260541; relay 20 is a Tempo model 260557 and relay 22 is a Tempo model 260557 or equivalent.

One of the features that makes the present invention very adaptable to different types of commercial copy machines is the fact that variations in warm-up and process times can be easily accomplished through the use of variable resistors R6 and R16 as described above. With the use of the instant invention, one can quickly and readily by the connection of two wires and a receptacle plug, adapt a conventional copy machine such that it can be utilized in a coin operational mode with a by-pass capability.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A control device for converting a conventional, electrostatic or bond copy machine from a manual print operation to a two-mode device for both coin operation or manual operation, the device comprising:

an inlet power source;

an electrical plug receptacle for receiving an inlet power line of the conventional copy machine;

a coin actuated switch connected to the inlet power source;

a power control relay coupled to said coin actuated switch;

a print signal actuating circuit connected to a print actuating control switch of the conventional copy machine;

time delay circuit means connected between said power control relay and said copy machine print actuating control switch for delaying a signal from the power relay to the print actuating control switch of the conventional copy machine; and a shut down relay connected to said time delay means and said power control relay for shutting off said power control relay after a predetermined amount of time.

2. A control device, as in claim 1, including:

a by-pass switch connected to said coin actuated switch and said power control relay; and a by-pass print switch connected to said by-pass switch.

3. A control device, as in claim 2, wherein:

said time delay means including a warm-up time delay circuit means connected to said power control relay and said copy machine actuating print switch for providing a warm-up delay after power is applied to said copy machine receptacle to delay the actuation of the print switch.

4. A control device, as in claim 3, including:

a process timing circuit connected to said warm-up circuit and said shut down relay, said process timing circuit being variable to allow for printing of a copy in a conventional machine prior to shutting down the power to the copy machine.

* * * * *